US005285976A

United States Patent [19]

Schmid et al.

[11] Patent Number: 5,285,976

[45] Date of Patent: Feb. 15, 1994

[54] UNWINDING DEVICE FOR PRINTING PRESSES

[75] Inventors: Gotthard Schmid, Nussloch, Fed. Rep. of Germany; Bryan C. Dustin, Rochester, N.H.

[73] Assignee: Heidelberg Harris, Inc., Dover, N.H.

[21] Appl. No.: 786,711

[22] Filed: Nov. 1, 1991

[51] Int. Cl.[5] ..... B65H 19/12; B65H 19/30

[52] U.S. Cl. ..... 242/55; 101/228; 242/68; 242/75.43

[58] Field of Search ..... 242/54 R, 55.3, 55.53, 242/58, 68, 75.43, 58.1, 55, 105; 101/228, 216, 223, 224, 227, 225

[56] References Cited

U.S. PATENT DOCUMENTS

| | | | |
|---|---|---|---|
| 1,908,121 | 5/1933 | Crafts | 242/75.43 |
| 2,075,192 | 3/1937 | George | 242/58.6 X |
| 4,433,816 | 2/1984 | Rousseau | 242/128 |
| 4,844,371 | 7/1989 | Tahara | 242/75.44 |
| 4,948,060 | 8/1990 | Kurz et al. | 242/58.1 |
| 5,060,569 | 10/1991 | Gladow | 101/216 |

FOREIGN PATENT DOCUMENTS

| | | | |
|---|---|---|---|
| 1034657 | 7/1958 | Fed. Rep. of Germany | 101/228 |
| 1908270 | 9/1970 | Fed. Rep. of Germany | 101/228 |
| 8912231.3 | 12/1989 | Fed. Rep. of Germany . | |
| 2189469 | 10/1987 | U.S.S.R. | 101/228 |
| 10121 | of 1912 | United Kingdom . | |
| 1214641 | 1/1967 | United Kingdom . | |
| 2228728 | 9/1990 | United Kingdom | 242/68 |

*Primary Examiner*—John M. Jillions
*Assistant Examiner*—John Rollins
*Attorney, Agent, or Firm*—Tarolli, Sundheim & Covell

[57] ABSTRACT

An unwinding apparatus supports a reel (60) of web material (22) which is to be unwound and directed into a printing unit (14) having a front/operator side and a rear/gear side. The unwinding apparatus comprises a frame (16) including a rear side part (28) located at the rear side of the printing press (14), and front side parts (24, 26) located at the front side of the printing press (14). The front side parts (24, 26) define an opening in the frame (16). Guide and locating bars (38) on the frame (16) extend from the rear side part (28) to the front side parts (24, 16) of the frame (16). The apparatus further comprises a movable reel cartridge (18) having front and rear cartridge frame parts (64, 66) for supporting the reel (60) of web material (22). The reel cartridge (18) is movable through the opening in the frame (16) and onto the guide and locating bars (38) to locate the reel (60) in its operating position.

7 Claims, 2 Drawing Sheets

UNWINDING DEVICE FOR PRINTING PRESSES

FIELD OF THE INVENTION

The present invention relates to a device for supporting a reel of web material which is to be unwound and directed into a printing press.

BACKGROUND OF THE INVENTION

U.S. Pat. No. 4,433,816 discloses a wire spool support in which a full wire spool is supported on a rack. The wire is guided over several spools for processing. The steadfastness of the rack is especially critical during high unwinding speeds. A continuing trouble free unwinding is not guaranteed at all unwinding speeds.

German Utility Model 89 12 231.3 discloses a swingable unwinding device for large reels. A stand built of two plates is swingably fastened on a base plate and accepts the shaft of a reel. The base plate is not displaceably mounted.

Also, a printing unit in a printing press can be supported above a respective individual unwinding unit. A reel of web material loaded into the unwinding unit is unwound upwardly from the unwinding unit into the printing unit. Depending upon the layout of printing units in the printing press, there may not be sufficient room adjacent to the unwinding unit for loading and unloading of the reel.

SUMMARY OF THE INVENTION

In accordance with the present invention, an unwinding apparatus supports a reel of web material which is to be located in an operating position, unwound, and directed into a printing press which has a front/operator's side and a rear/gear side. The apparatus comprises a frame including a rear side part located at the rear/gear side of the printing press, and front side parts located at the front/operator's side of the printing press. The front side parts define an opening in the frame. An idler roll on the frame guides the web from the reel. Guide and locating bars on the frame extend from the rear side to the front side. The apparatus further comprises a movable reel cartridge having front and rear cartridge frame parts for supporting the reel. The cartridge is movable through the opening in the frame and onto the guide and locating bars to locate the reel in the operating position.

An unwinding apparatus constructed in accordance with the invention enables the reel to be loaded from the front/operator's side. The reel of web material is loaded onto the cartridge at a location outside of the frame, and is moved into the frame with the cartridge. In the preferred embodiment of the invention, the guide and locating bars on the frame support the cartridge in a position wherein the reel is coaxially aligned with a reel brake supported on the frame. A plurality of interchangeable cartridges can be used in a printing press, with the guide and locating bars in each unwinding unit assuring that each cartridge will be supported in a position wherein the associated reel is coaxial with the associated brake.

BRIEF DESCRIPTION OF THE DRAWINGS

The foregoing and other features of the present invention will become apparent to those skilled in the art upon reading the following description of a preferred embodiment of the invention in view of the accompanying drawings, wherein.

DESCRIPTION OF A PREFERRED EMBODIMENT

Figure 1:
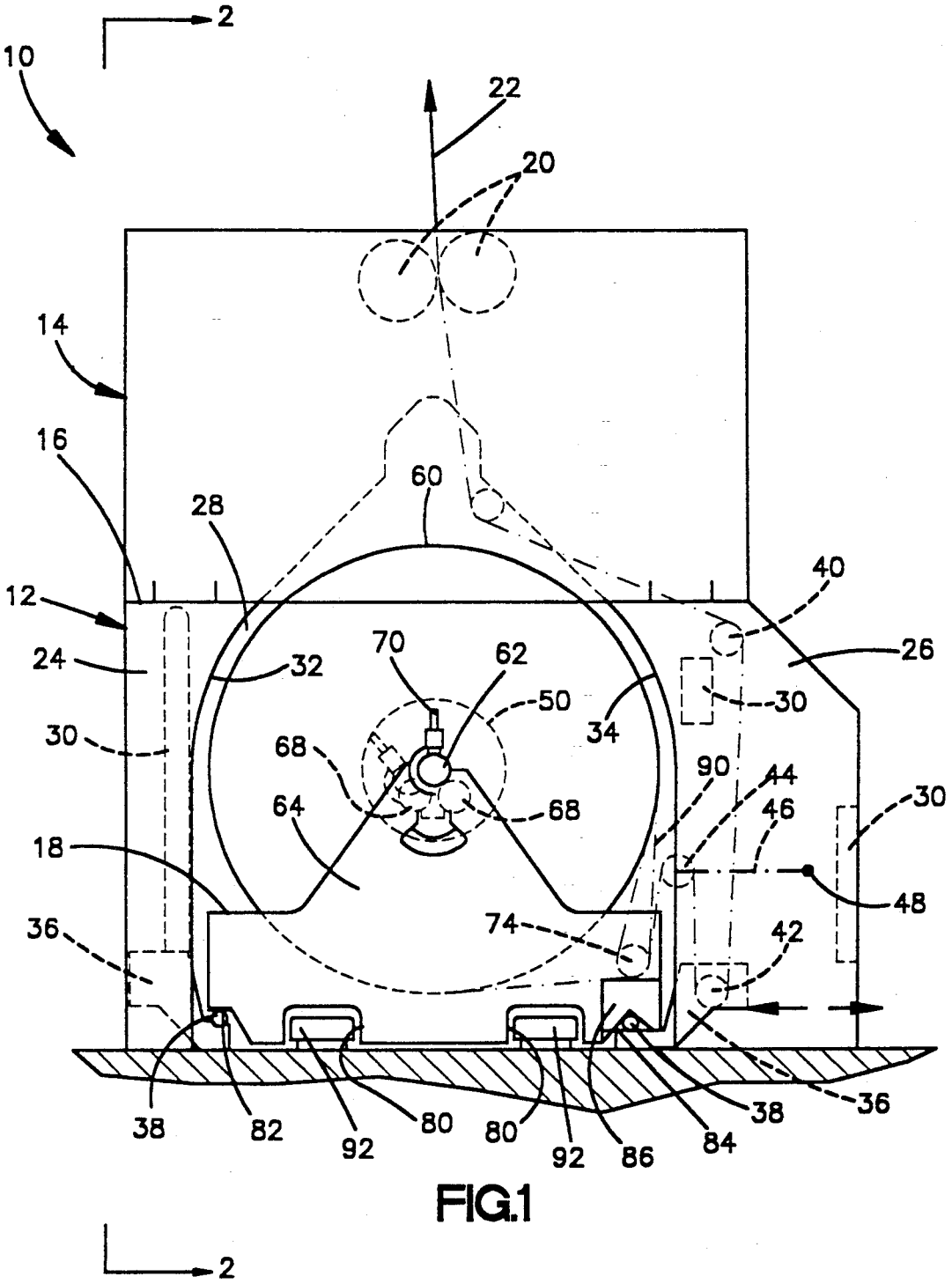
FIG. 1 is a front schematic view of a printing apparatus constructed in accordance with the present invention.

As shown in FIG. 1, a printing apparatus 10 constructed in accordance with the present invention comprises an unwinding device 12 and a printing unit 14. The unwinding device 12 includes a frame 16 and a cartridge 18. The cartridge 18 is movable into and out of the frame 16, and the printing unit 14 is supported on top of the frame 16. The printing unit 14 includes a pair of printing rolls 20 for printing on a web material 22 extending from the unwinding device 12 through the printing unit 14.

Figure 2:
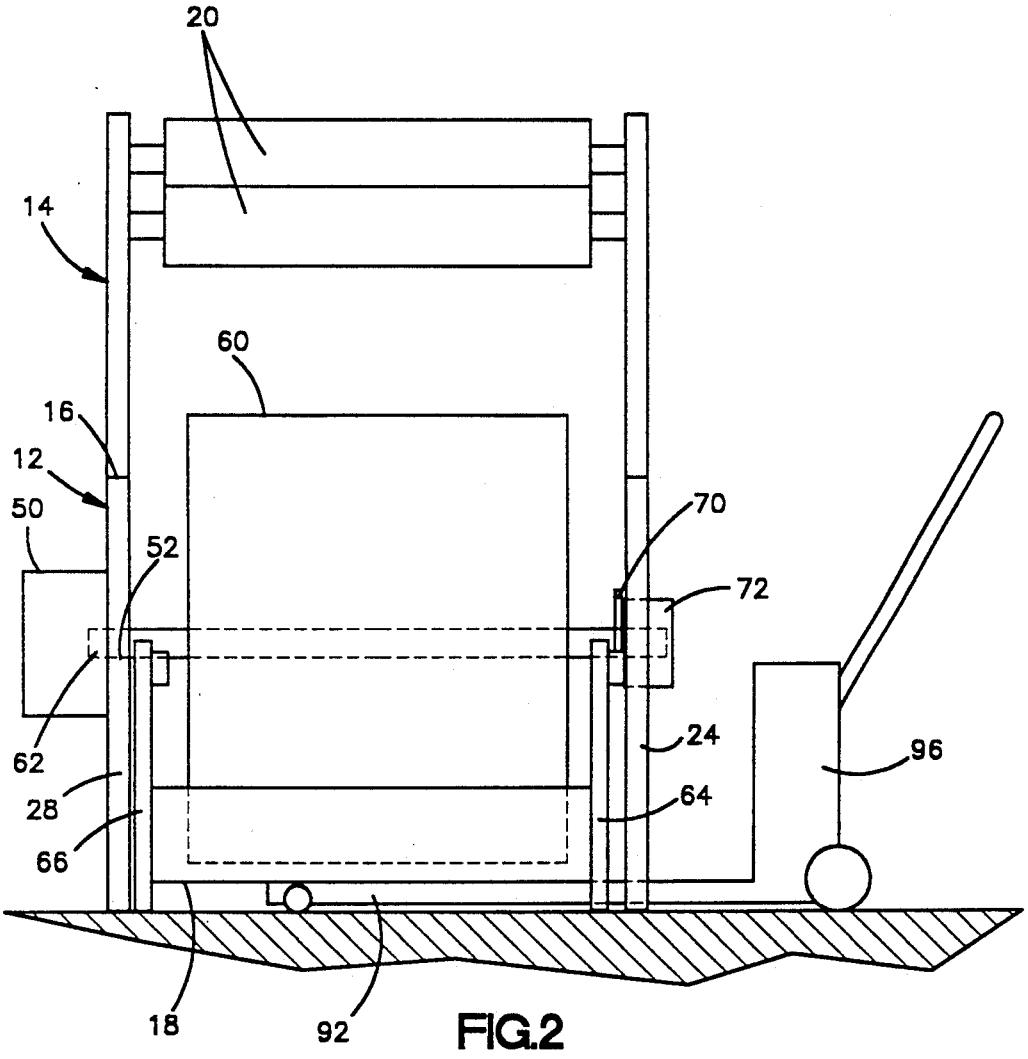
FIG. 2 is a view taken on line 2—2 of FIG. 1, with parts removed for clarity of illustration.

As shown in FIGS. 1 and 2, the frame 16 is a generally rectangular structure. A pair of spaced-apart frame parts 24 and 26 define the front/operator's side of the frame 16. A single frame part 28 defines the rear/gear side of the frame 16. A plurality of cross-ties 30 fix the frame parts 24 and 26 to the frame part 28. The frame parts 24 and 26 have respective edge surfaces 32 and 34 which face each other across the front/operator's side of the frame 16. The edge surfaces 32 and 34 define an opening through which the cartridge 18 is movable.

A pair of brackets 36 are fixed to the frame parts 24 and 26 at the front/operator's side of the frame 16. The brackets 36 extend inwardly of the opening defined between the edge surfaces 32 and 34. A pair of guide and locating bars 38 have their front ends fixed to the brackets 36 and their rear ends fixed to the frame part 28. The guide and locating bars 38 are parallel to each other, and are located between the edge surfaces 32 and 34 which define the opening at the front/operator's side of the frame 16.

A plurality of web guiding rolls extend across the inside of the frame 16. These include an upper idler roll 40, a lower idler roll 42 and a compensating roll 44. A compensating mechanism 46 of known construction is associated with the compensating roll 44. The compensating mechanism 46 enables limited pivotal movement of the compensating roll 44 about a hub 48 in a known manner. A brake 50 is supported on the frame part 28 adjacent to a brake opening 52 at the rear/gear side of the frame 16. The brake 50 is operatively associated with the compensating mechanism 46 in a known manner.

As shown in FIGS. 1 and 2, the cartridge 18 supports a reel 60 of the web material 22. The reel 60 has a reel core 62. The cartridge 18 has a pair of spaced-apart cartridge frame parts 64 and 64. Each of the cartridge frame parts 64 and 66 has a pair of roller bearings 68 upon which an end portion of the reel core 62 is supported for rotation. A core lock 70 is pivotally mounted on the cartridge frame part 64. The core lock 70 is movable into and out of a position engaging the reel core 62 to hold the reel core 62 against axial movement on the cartridge 18. A sidelay mechanism 72 is also supported on the cartridge frame part 64. The sidelay mechanism 72 operates to adjust the axial position of the reel core 62 on the cartridge 18. The core lock 70 and the sidelay mechanism 72 are of known construction, and cooperate with each other and with the reel core 62 in a known manner. The cartridge frame parts 64 and 66 also support an idler roll 74 extending across the cartridge 18.

The cartridge 18 further includes lifting openings 80 and mounting surfaces 82 and 84. The mounting surfaces 82 at the left hand side of the cartridge 18, as shown in FIG. 1, are defined by horizontal lower edge surfaces of the cartridge frame parts 64 and 66. The mounting surfaces 84 at the right hand side the cartridge 18 are defined by angular lower edge surfaces on plates 86 which are fixed to the cartridge frame parts 64 and 66. When the cartridge 18 is in the operating position shown in FIGS. 1 and 2, the mounting surfaces 82 and 84 rest on the guide and locating bars 38, and the reel core 62 is coaxial with the brake opening 52 in the frame part 28.

In use of the printing apparatus 10, the cartridge 18 is moved into and out of the operating position shown in FIG. 1. The reel 60 of web material 22 is first loaded onto the cartridge 18 at a location outside of the frame 16 by clamping the reel core 62 onto the roller bearings 68 with the core lock 70. The leading end portion 90 of the web material 22 is then wrapped around the idler roll 74 and taped to the reel 60 at the right hand side of the reel 60, as shown in FIG. 1. The leading end portion 90 of the web material 22 is thus located in an accessible position.

After the reel 60 is loaded onto the cartridge 18, the cartridge 18 is moved in through the opening at the front side of the frame 16 by the lifting arms 92 of a fork lift 96 or the like, and is lowered onto the guide and locating bars 38. The reel 60 is thus moved into the frame 16 in a direction which is parallel to the axis of the reel 60 and the axes of the printing rolls 20 in the printing unit 14. Because the reel core 62 is coaxial with the brake opening 52 when the cartridge 18 rests on the guide and locating bars 38, the sidelay mechanism 72 can then be operated as needed to move the reel core 62 through the brake opening 52 into engagement with the brake 50. In accordance with this feature of the invention, the plates 86 are mounted on the cartridge frame parts 64 and 66 in positions that assure coaxial alignment of the reel core 62 and the brake opening 52 when the cartridge 18 rests on the guide and locating bars 38. A plurality of cartridges constructed like the cartridge 18 are therefore interchangeable in the frame 16 and in other frames like the frame 16.

After the cartridge 18 is moved into the operating position in the frame 16, the leading end portion 90 of the web material 22 can be threaded along the path shown to extend between the printing cylinders 20 in the printing unit 14, or can alternately be threaded along a path extending out from the lower right hand side of the frame 16 to a different printing unit (not shown). As the web material 22 is moved longitudinally through the printing unit 14 by the printing rolls 20, it is unwound from the reel 60. Tension in the web material 22 between the reel 60 and the printing unit 14 is controlled by the compensating roll 44, which acts directly on the web 22, and by the brake 50, which acts directly on the reel core 62. When the reel 60 of web material 22 is depleted, the cartridge 18 can be removed for replacement of the reel 60 or for replacement of the cartridge 18 with another cartridge holding another reel.

From the above description of the invention, those skilled in the art will perceive improvements, changes and modifications. Such improvements, changes and modifications within the skill of the art are intended to be covered by the appended claims.

Having described the invention, the following is claimed:

1. Apparatus for supporting a reel (60) of web material (22) which is to be unwound from the reel (60) and directed into a web processing machine (14) having a front/operator's side and a rear/gear side, said apparatus comprising:

a cartridge (18) having front and rear cartridge frame parts (64, 66), said front and rear cartridge frame parts (66, 66) having means for holding the reel (60) in a loaded position extending axially from said front cartridge frame part (64) to said rear cartridge frame part (66), said cartridge (18) further having a mounting surface means including downwardly facing mounting surfaces (82, 84); and means for defining a stationary frame (16) having a front side at the front/operator's side of the web processing machine (14), a rear side at the rear/-gear side of the web processing machine (14), and a space for containing said cartridge (18) within said stationary frame (16) between said front and rear sides of said stationary frame (16), said front side of said stationary frame (16) having an opening through which said cartridge (18) is movable;

said stationary frame (16) further having a supporting means for supporting the weight of said cartridge (18) on said stationary frame (16), said supporting means including a pair of locating bars (38) extending longitudinally across the inside of said stationary frame (16) between said front and rear sides of said stationary frame (16), said locating bars (38) being spaced transversely from each other across said opening;

said cartridge (18) being movable horizontally through said opening in said front side of said stationary frame (16) to carry the reel (60) axially into and out of said space, said cartridge (18) being thus movable horizontally into and out of an intermediate position in which said mounting surfaces (82, 84) are located directly above said locating bars (38);

said cartridge (18) being further movable vertically in said space relative to said locating bars (38), said cartridge (18) being thus movable between said intermediate position and an operating position in which said mounting surfaces (82, 84) register with and rest on said locating bars (38) to impose the weight of said cartridge (18) onto said locating bars (38) and thereby to mount said cartridge (18) releasably on said locating bars (38).

2. Apparatus as defined in claim 1 wherein said cartridge (18) further has a lifting surface means for supporting said cartridge releasably on the lifting arms (92) of a lifting apparatus (96), said lifting surface means defining openings (80) for receiving the lifting arms (92) through said front cartridge frame part (64).

3. Apparatus as defined in claim 1 wherein said cartridge (18) further has a web guiding means for supporting a leading end portion (90) of the web material (22) in an accessible position extending outward from the reel (60) when the reel (60) is in the loaded position, said web guiding means comprising an idler roll (74) extending axially between said front and rear cartridge frame parts (64, 66).

4. Apparatus as defined in claim 3 wherein said stationary frame (16) further has a web tension controlling means for controlling the tension in the web material (22) extending from said idler roll (74) on said cartridge (18) to the web processing machine (14), said web tension controlling means comprising a compensating roll (44) extending axially between said front and rear sides of said stationary frame (16).

5. Apparatus as defined in claim 4 wherein said stationary frame (16) supports first and second idler rolls (40, 42) extending axially between said front and rear sides of said stationary frame (16).

6. Apparatus as defined in claim 1 wherein said rear side of said stationary frame (16) supports a brake (5) for braking rotation of the reel (60) when the reel (60) is supported on said cartridge (18) in the loaded position.

7. Apparatus as defined in claim 1 wherein said means for supporting the reel (60) in a loaded position comprises bearings (68) for supporting the reel (60) for rotation, a reel core locking means (70) for blocking axial movement of the reel (60) on said cartridge (18), and a sidelay adjustment means (72) for adjusting the axial position of the reel (60) on said cartridge (18).

* * * * *